US005715725A

United States Patent [19]

Schnell et al.

[11] Patent Number: 5,715,725

[45] Date of Patent: Feb. 10, 1998

[54] BIAXIAL TRAVELLING CLAMP FOR SECURING A TOOL TO A PRESS

[75] Inventors: Richard E. Schnell, Oswego; Clifford H. Rogers, Sandwich, both of Ill.

[73] Assignee: Applied Power Inc., Butler, Wis.

[21] Appl. No.: 682,944

[22] Filed: Jul. 16, 1996

[51] Int. Cl.[6] ..... B21D 37/14

[52] U.S. Cl. ..... 72/481.2; 72/481.6

[58] Field of Search ..... 72/481.1, 481.2, 72/481.6, 482.8

[56] References Cited

U.S. PATENT DOCUMENTS

| | | | |
|---|---|---|---|
| 4,674,315 | 6/1987 | Linz | 72/481.2 |
| 4,698,894 | 10/1987 | Lingaraju et al. | 72/481.2 |
| 4,790,174 | 12/1988 | Wendland | 72/481.2 |

FOREIGN PATENT DOCUMENTS

| | | | |
|---|---|---|---|
| 2-11231 | 1/1990 | Japan | 72/446 |
| 2-112832 | 4/1990 | Japan | 72/481.2 |

OTHER PUBLICATIONS

Exhibit 1—Enerpac® Press Support Systems brochure, "Complete Press Systems Integration", Pub. #9614–916, 3–96, admitted prior art.

Exhibit 2—Enerpac® Quick Die Change Products brochure, "Travelling Upper Die Clamp–Electric Drive", Pub. #9610–914, undated, admitted prior art.

Exhibit 3—Enerpac® Quick Die Change Products brochure, "Technical Data Electric Driver for Traveling Clamp TR***–*", Pub. #9605–911, undated, admitted prior art.

Exhibit 4—R2 Overview, R2S—Step Motor, pp. C–6 and C–7, undated, admitted prior art.

*Primary Examiner*—David Jones

*Attorney, Agent, or Firm*—Quarles & Brady

[57] ABSTRACT

The platen of a press which is provided with multiple longitudinally running T-slots for clamping a tool such as a die or mold to the platen has a frame secured to it which supports and guides a travelling clamp so that the travelling clamp can be moved laterally to serve any one of several T-slots in the platen. In one embodiment, a face drive unit has its motor fixed relative to the frame so as to drive the travelling clamp laterally. In another embodiment, the frame supports multiple travelling clamps and each clamp is provided with its own lateral drive along a frame which extends along the face of the press slide and is common to the travelling clamps. Brake cylinders maybe provided for fixing the travelling clamp to the frame during press operation.

11 Claims, 9 Drawing Sheets

BIAXIAL TRAVELLING CLAMP FOR SECURING A TOOL TO A PRESS

BACKGROUND OF THE INVENTION

1. Field of the Invention

This invention relates to tool clamps of the type for securing a mold or die to the platen of a press, and in particular to travelling clamps.

2. Discussion of the Prior Art

FIG. 1 illustrates a prior art press in which a lower die 1 is secured to the bolster platen 2 of the press and an upper die 3 is secured to the slide platen 4 of the press. As shown in FIGS. 2, 3, 4 and 5, the slide platen 4 is provided with a number of spaced T-slots 5 in which the T-shaped clamp head 6 of a hydraulically operated travelling clamp 7 can be slidably received. The unit 7 has drive means including an electric motor 9 which drives chain 8 so as to extend clamp head 6 into and out of the T-slot 5 with which it is aligned when the upper die 3 is to be attached against the platen or confronting face of the slide 4. Clamping cylinder 10 is then hydraulically actuated, with hydraulic pressure supplied by hose 11, so as to bear with the rod end of the cylinder against a flange of the die 3 to clamp the die 3 tightly against the platen of the slide 4. T-slots may also be provided in the bolster platen 2 for automatically clamping the lower die 1 to the bolster platen 2 using travelling clamps 7, as shown in FIG. 3.

Typically, each unit 7 is fixed to the press slide side face at a single desired T-slot which is expected to be used and which is the only T-slot that the unit 7 serves. If the press only uses dies that are built to a standard clamping configuration, then the clamp positions are all known and do not need to be modified. However, if the application incorporates old and new dies of various configurations or is a press designed for "die try out", where any configuration for securing the die is possible, then the clamps are typically placed on at least every other T-slot in the hope of being able to select enough clamps to clamp the required die, considering the number of clamps required to support the weight of the die. Otherwise, to make certain that any foreseeable configuration will be possible, a unit 7 is secured to the slide at every T-slot location. The press operator then activates only those units 7 which are appropriate for securing the particular die which is being secured to the slide. Thus, it has been the case that many more of the units 7 were required to be dedicated to a press than are actually used in many applications of securing a die or mold to the press.

SUMMARY OF THE INVENTION

As a solution to this problem, the invention provides a frame for supporting and guiding the travelling clamp laterally into alignment with any one of several T-slots in the platen so as to be extendable longitudinally into a desired one of the T-slots. Thus, a single travelling clamp can serve any number of T-slots to secure a tool to the press. Since several T-slots can be served by a single travelling clamp, the number of travelling clamps dedicated to a press is reduced in many applications.

Preferably, a power drive is provided which moves the travelling clamp laterally along the frame to align it with any one of several T-slots. If not, the travelling clamp can be manually moved to align the T-head of its clamping cylinder with the desired T-slot.

In another useful aspect, the frame has T-slots which are aligned with T-slots in the platen. These support the T-head of the clamping cylinder as it moves longitudinally from the travelling clamp into the T-slot of the platen, and also provide references with which to align the frame when it is installed on the platen. In addition, T-slots in the frame provide references for aligning the travelling clamp with the T-slots in the platen as the travelling clamp is moved laterally. In addition, other identifying indicia or reference marks may be provided on the frame relative to the T-slots in the frame for automatically aligning the travelling clamp with the T-slots.

In one useful aspect of the invention, at least two travelling clamps are supported and guided by the frame and movable relative thereto, each to serve a plurality of T-slots. In this aspect, at least one of the T-slots is preferably serviceable by either of the clamps. This provides for the most efficient use of travelling clamps, since each clamp is capable of serving several T-slots, and the T-slots which each clamp serves overlap with the T-slots which other travelling clamps serve. This aspect of the invention is preferably executed by providing each travelling clamp with a separate drive which drives the clamp along a gear rack which is common to all the clamps.

These and other objects and advantages of the invention will be apparent from the detailed description and drawings.

DETAILED DESCRIPTION OF THE PREFERRED EMBODIMENTS

Figure 1:
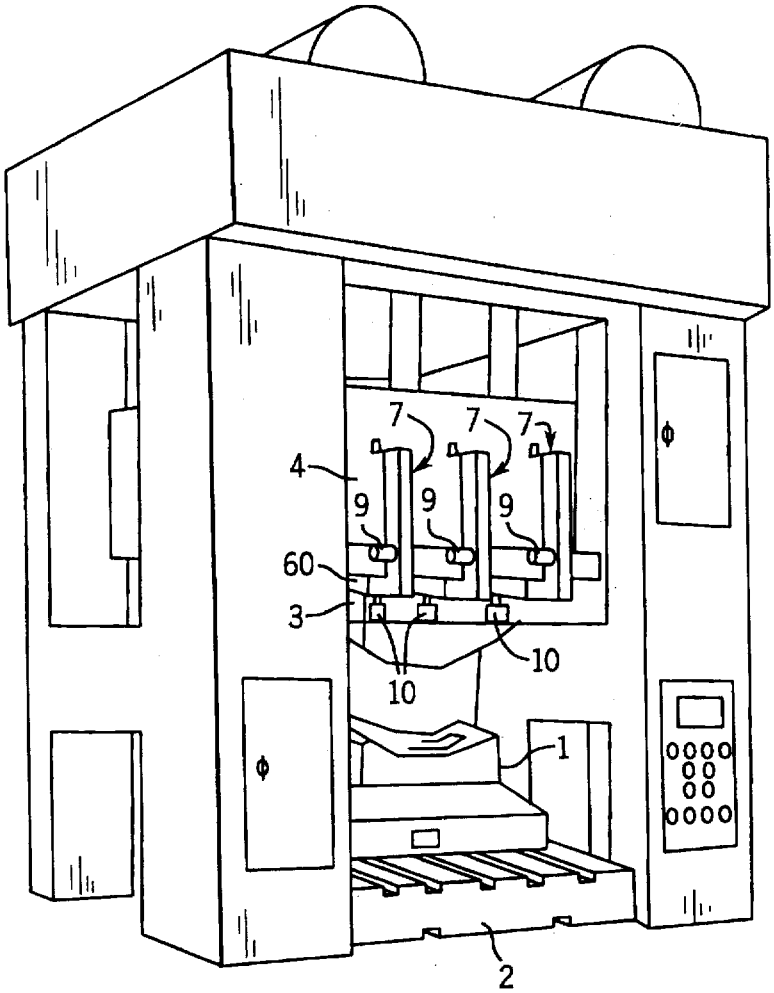
FIG. 1 PRIOR ART
FIG. 1 is a perspective view of a typical press configuration employing travelling clamps 7 for securing a metal stamping die 3 to the slide platen 4 of the press.
Figure 2:
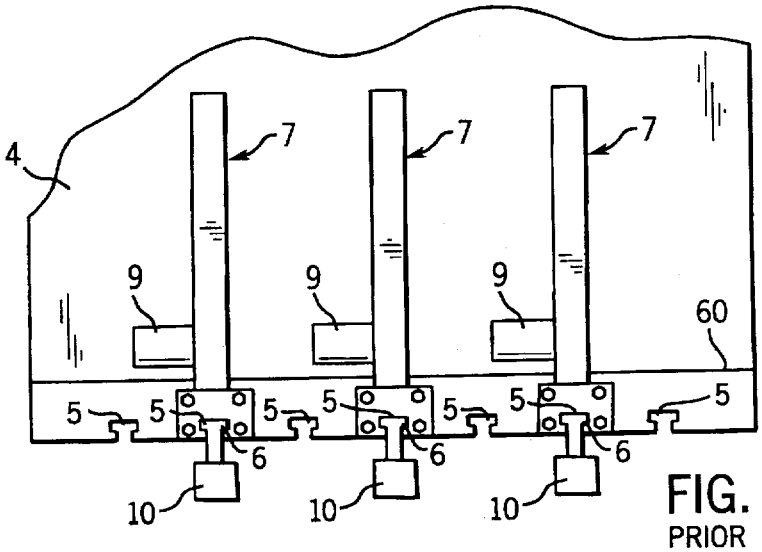
FIG. 2 PRIOR ART
FIG. 2 is a front elevation fragmentary view illustrating the travelling clamps 7 and the T-slots 5 in the slide platen 4 of the press, without the die 3.
Figure 3:
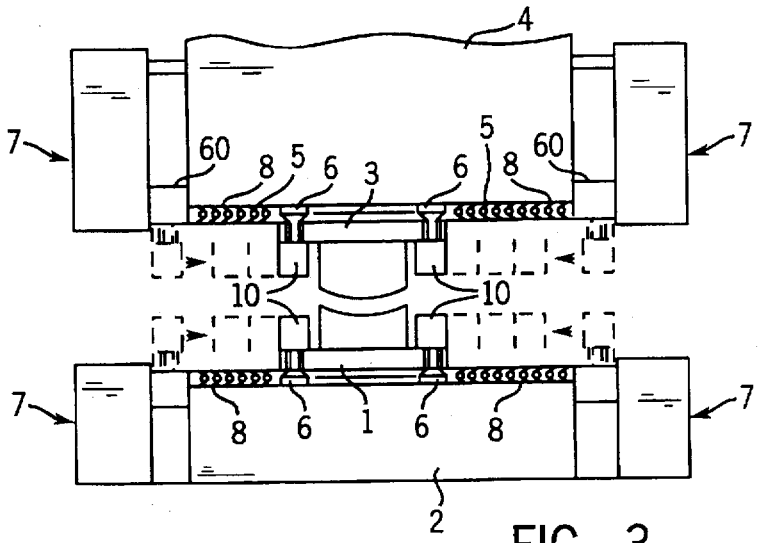
FIG. 3 PRIOR ART
FIG. 3 is a schematic elevation view illustrating the travelling clamps 7 in an extended position clamping the upper die 3 to the slide platen 4 of a press. Units 7 are also illustrated clamping the lower die 1 to the bolster plate 2.
Figure 4:
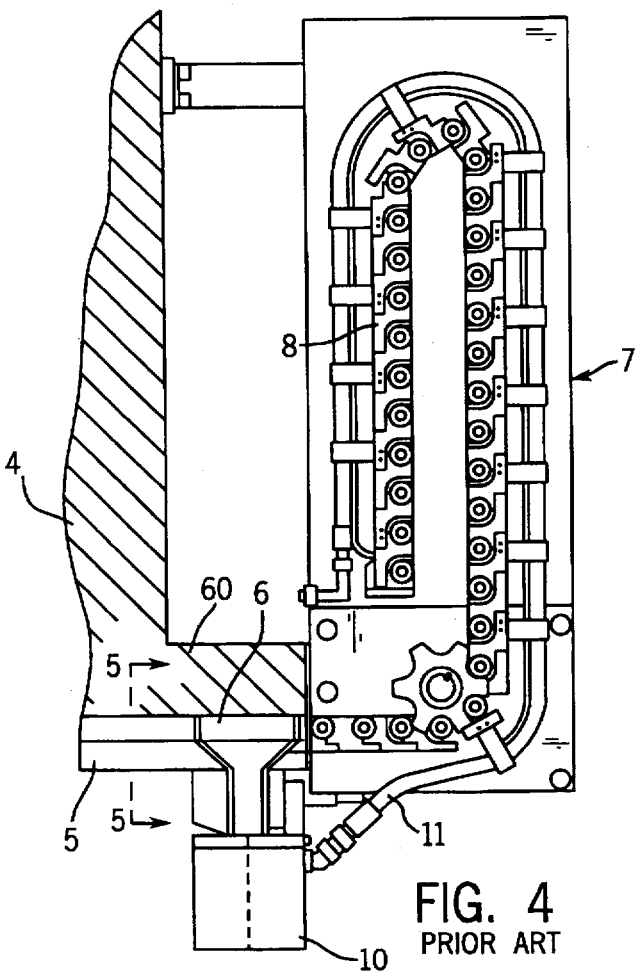
FIG. 4 PRIOR ART
FIG. 4 is a schematic view illustrating the basic operating components of a typical prior art travelling clamp 7 of the type that is incorporated in the present invention, with the clamp head 6 partially extended into the T-slot 5 of a flange 60 of the slide platen 4.
Figure 5:
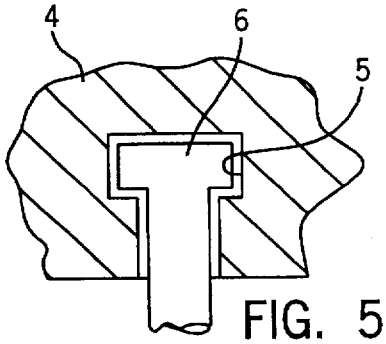
FIG. 5 PRIOR ART
FIG. 5 is a fragmentary sectional view as viewed from the plane of the line 5—5 of FIG. 4 illustrating a T-slot 5 in the slide platen 4 of the press with the T-shaped head 6 of the clamping cylinder 10 supported in the T-slot 5.
Figure 6:
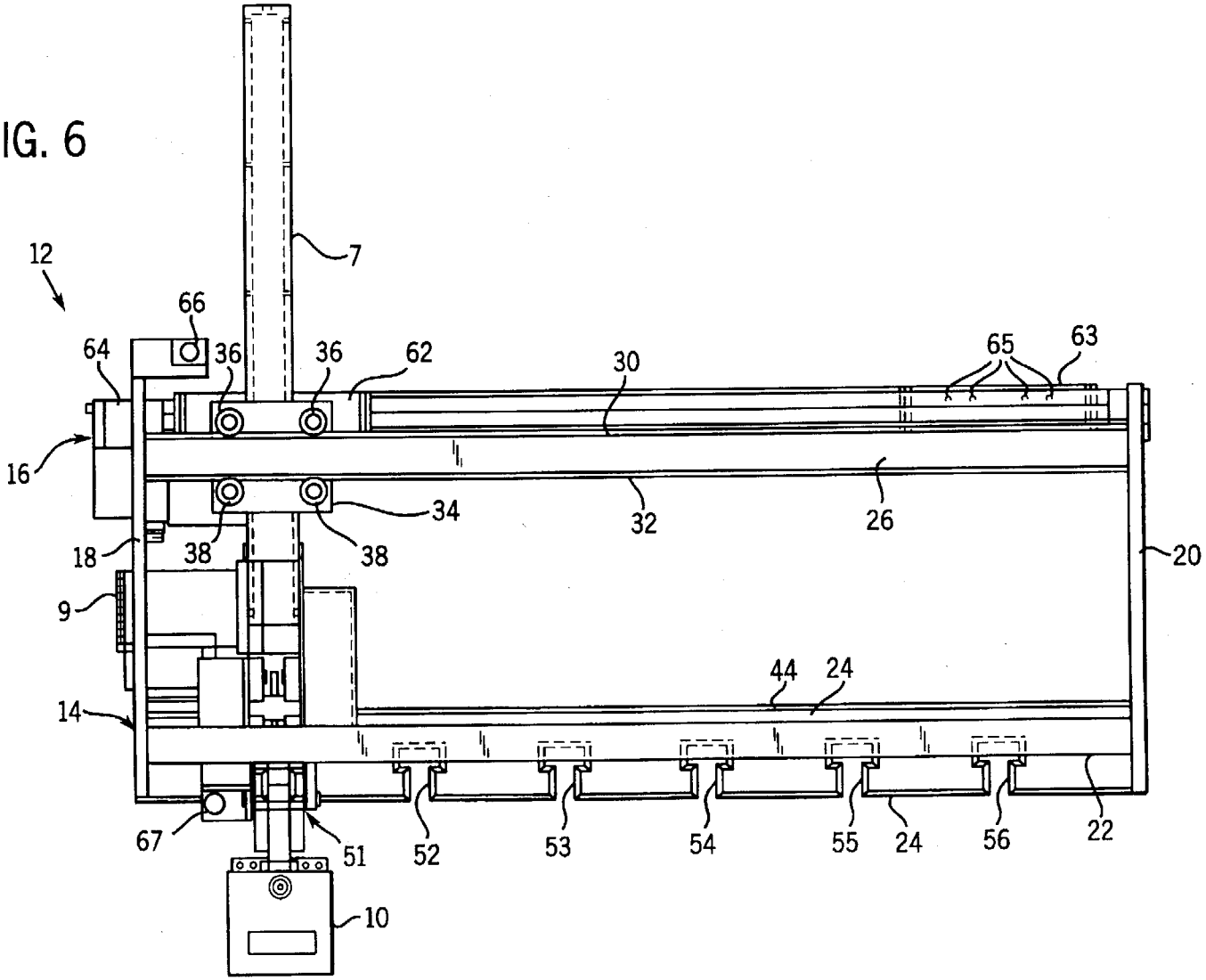
FIG. 6 is a front plan view of a biaxial travelling clamp 12 of the invention.
Figure 7:
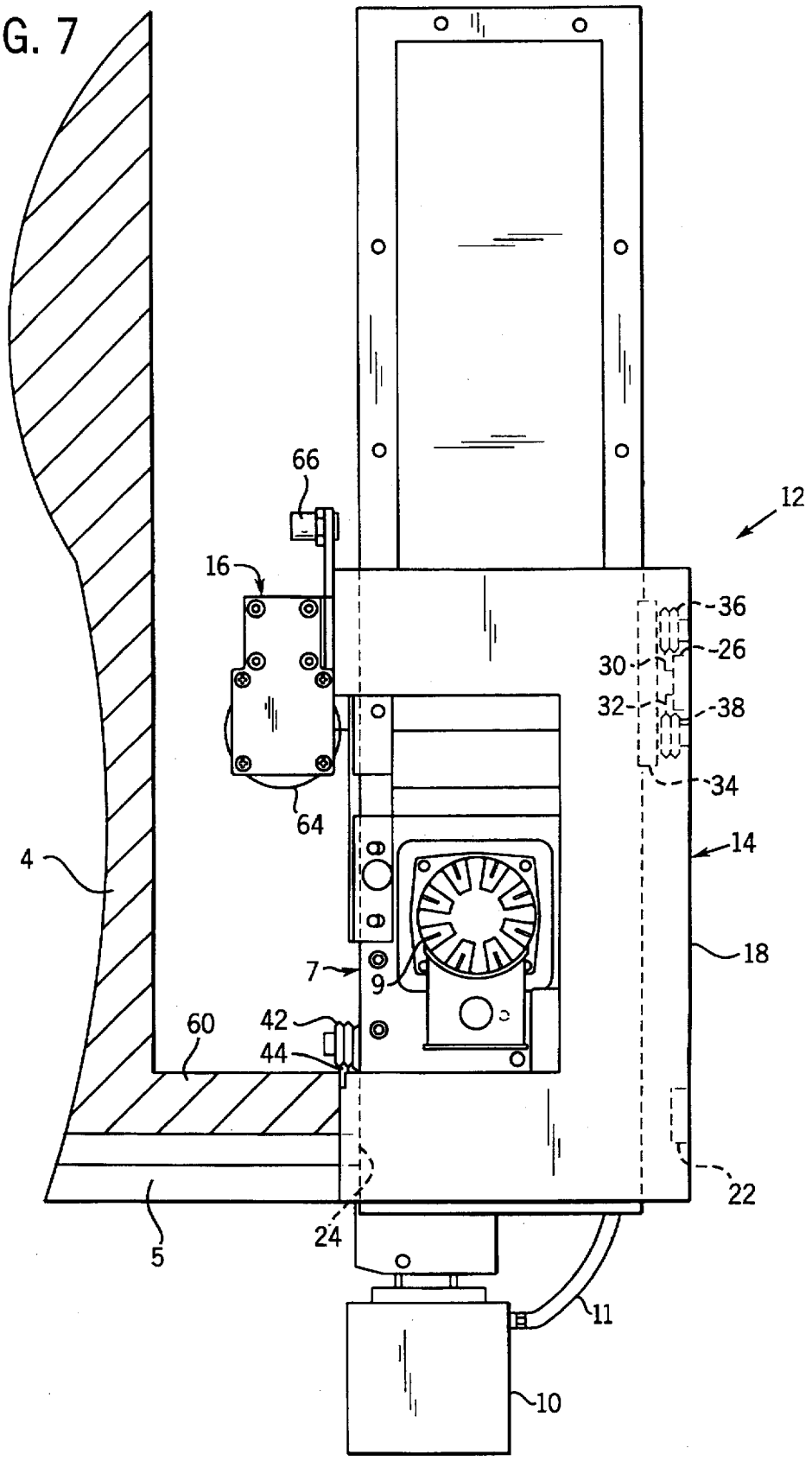
FIG. 7 is a side plan view of the biaxial travelling clamp 12 of FIG. 6 illustrated in position relative to a slide platen 4 of a press.

FIGS. 6 and 7 illustrate front and side views of a biaxial travelling clamp 12 of the invention. As illustrated, a singleaxis travelling clamp assembly 7, similar to the travelling clamp assembly 7 illustrated in FIG. 4, is mounted to a lateral support frame 14 so as to be slidable along the frame to any of a number of T-slot positions 51–56 as illustrated in FIG. 6. A power linear drive unit 16 is provided, which is fixed to the frame 14, to precisely move the clamp assembly 7 laterally to any of the T-slot locations 51–56.

Figure 8:
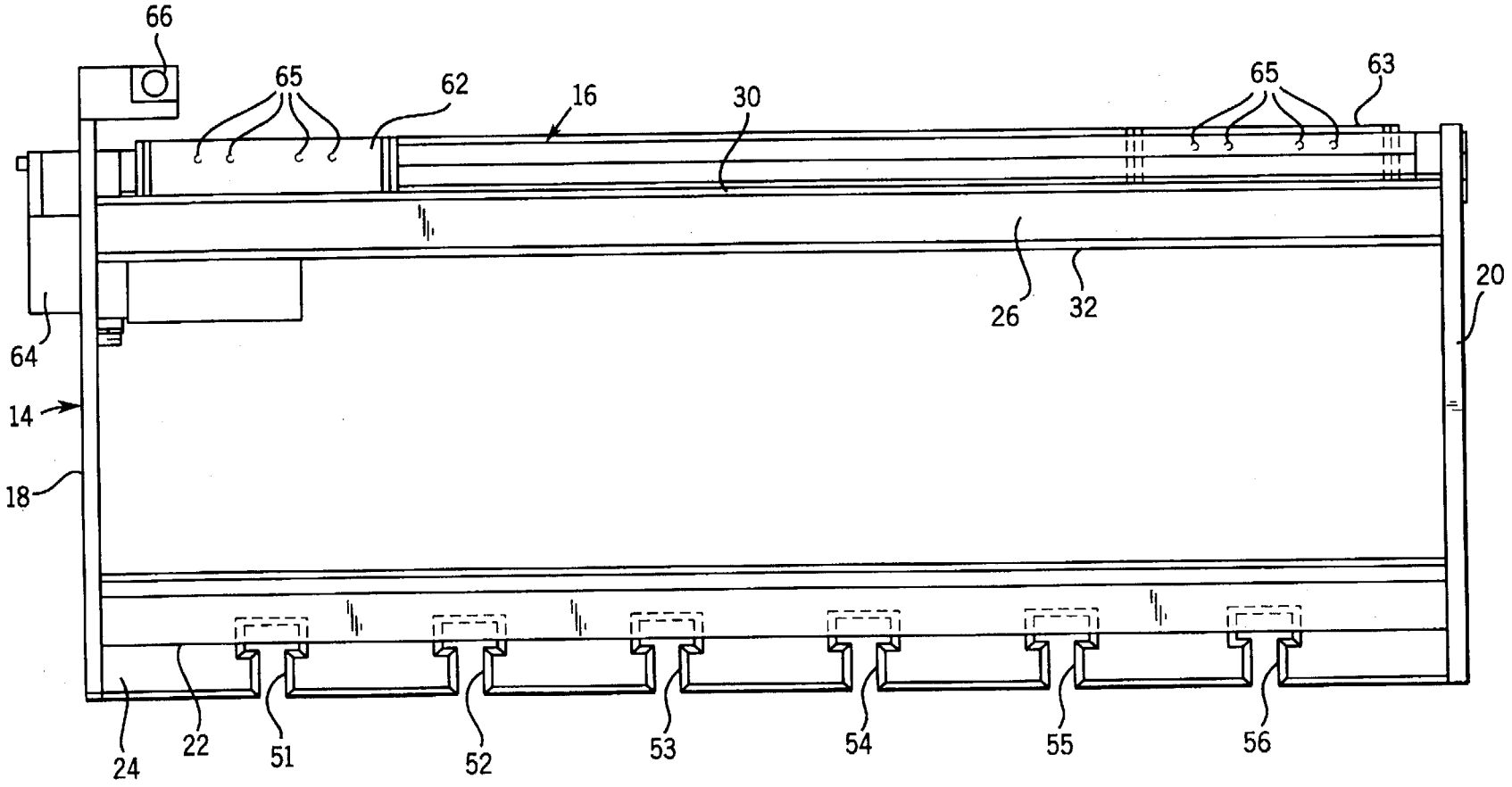
FIG. 8 is a front plan view of a frame 14 and lateral drive 16 of the unit of FIG. 6.
Figure 9:
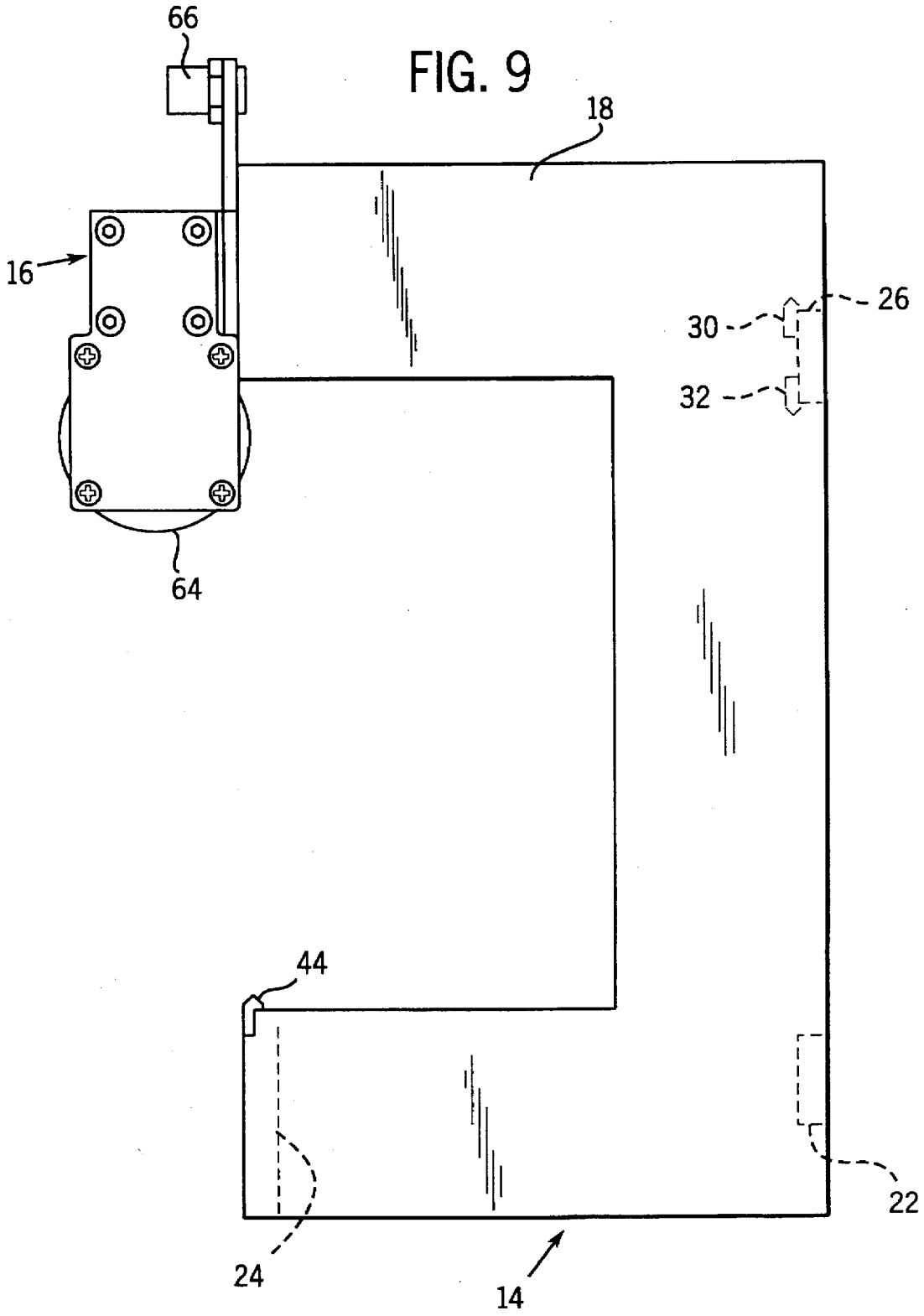
FIG. 9 is a side plan view of the frame 14 and drive 16 of FIG. 8.

Referring also to FIGS. 8 and 9, the support frame 14 is of welded steel construction including C-shaped side plates 18 and 20 which are spaced apart and spanned by a front bar 22, a rear bar 24, a guide rail 26, and the drive unit 16. The bars 22 and 24 and the guide rail 26 are affixed, for example by welding, fasteners or other suitable means, to the plates 18 and 20 at their ends.

The power drive unit 16 is a standard face drive unit which is attached to the support frame by any suitable means so as to be in operative relationship for driving the clamp assembly 7 laterally along the support frame 14. A commercially available unit suitable for this purpose is, for example, a DC motor driven unit incorporating a belt drive for conversion to linear motion. Such a unit is commercially available from Industrial Devices Corp. of Novato, Calif. as Model No. R2H-105A-30PR-MF3E. However, it should be understood that the invention is not limited to such a power drive unit, but that the travelling clamp 7 could be moved laterally by any of a number of different alternatives, including linear motors such as an air cylinder or a hydraulic cylinder and rotational motors such as an AC electric motor, an air motor, a hydraulic motor, or an electric stepper motor, incorporating or not incorporating gears, sprockets, worm gears, motor control electronics, position feedback electronics, and other drive and positioning components, well-known in the art.

The upper and lower edges of the guide rail 26 (FIG. 7) are provided with trackways 30 and 32 which respectively present upwardly and downwardly facing V-shaped surfaces. An upper roller support plate 34 is secured to the back of the travelling clamp assembly 7 by bolts or other suitable means (not shown). Two V-groove rollers 36 are mounted on the plate 34 in rolling engagement with the upper trackway 30, and two V-groove rollers 38 are mounted to the plate 34 in rolling engagement with the lower trackway 32. In addition, a pair of rollers 42, only one of which is visible in FIG. 7, are provided on the front of assembly 12 secured thereto by a bolt or other suitable means in rolling engagement with a lower trackway 44 which is secured on the upper edge of the rear bar 24 and presents an upwardly facing V-shaped surface to guide the rollers 42. Thus, the clamp 7 can be moved laterally back and forth relative to the frame 14 as the rollers 36, 38, and 42 roll along their respective trackways 30, 32, and 44.

T-slots 51–56 are formed in the rear bar 24 at positions corresponding to the T-slots 5 in the slide, which extend into and open at the front side surface of the slide flange 60 (see FIG. 7). Thus, each of the T-slots 51–56 is lined up with one of the T-slots 5 in the slide. The frame 14 is secured to the slide 4 by any suitable means, such as by welding it to the flange 60.

The drive unit 16 has a shuttle 62 which is driven linearly back and forth along the unit 16 by the unit's electric motor 64 driving a belt (not shown) which is fixed to the guide 62. The clamp assembly 7 is fixed to the guide 62 so that the drive unit 16 drives the clamp assembly 7 back and forth, according to appropriate commands received from a control unit (not shown), which may be part of the press control unit. The position of the guide 62 in a far right position is shown in phantom at 63 in FIG. 6. Bolt holes 65 for mounting the guide 62 to the unit 7 are also shown in phantom at 65.

For the purpose of positioning the clamp assembly 7 at a desired one of the T-slots 51–56, a home position proximity switch 66 is provided to detect when the clamp assembly 7 is in a home position at the far left of FIG. 6 in which it is lined up with the switch 66. Then, a proximity switch or other suitable sensor 67 may be provided on the unit 12 to count the desired number of T-slots over from the proximity switch 66 so as to stop at the desired T-slot, which is requested by the press operator via the control panel. At the desired number minus one, the drive unit may be given a signal to go to slow speed so that when the desired slot is reached and a stop signal is given, the unit stops accurately where required. Bar codes or other identifying indicia may be applied to the slide front side face for detection by the sensor 67.

Alternatively, a design could be employed which incorporates a linear voltage displacement transducer (LVDT) to replace the function of the sensor 67 on the assembly 7. For example, an LVDT may be provided in the drive for the belt of the unit 16 to give an indication of the position of the assembly 7 relative to each slot 51–56. Once the assembly 7 is in position, lined up with the desired T-slot, the clamp 7 is given a "go" signal. At that point, normal clamping operations are begun just as on the current prior art units 7, the unit 7 reeling out its chain 8 and clamp cylinder 10 so as to clamp the die 3 against the slide 4.

The travelling clamp 7, which is employed in the invention, may be of any suitable type. In the preferred embodiment, the clamp assembly 7 is a commercially available unit which is an electric motor driven chain type travelling clamp manufactured by Enerpac, Butler, Wis., as Model No. TRA. Additional details of such a travelling clamp are disclosed in copending, commonly owned U.S. patent application Ser. No. 08/682,947, filed on the same day as this application, entitled "Travelling Clamp With Removeable Rails", the disclosure of which is hereby incorporated by reference. Alternatively, the travelling clamp unit 7 could incorporate a belt or cable drive (rather than a chain drive as disclosed), a direct air or hydraulic cylinder drive, an air cylinder and chain, belt, or cable drive, an air or hydraulic motor drive with chain, belt, or cable, or an electric motor, hydraulic motor, or air motor with worm gear drive. In summary, any method of developing linear motion to move the T-shaped head 6 of cylinder 10 longitudinally into and out of the T-slots 51–56 and 5 may be used.

The purpose of the invention is to reduce the number of travelling die clamps 7 required and still meet the die clamping requirements of the press for a variety of different dies. Typically, two of the units 12 may be provided on each side of the slide of the press for a total of four of the units 12. If the die weight requires more than four clamps minimum or if a press is going to have more than one die at a time installed, then more of the units 12 covering fewer T-slots each could be used. It should also be noted that although the unit 12 is shown as being able to serve six T-slots with a single travelling clamp assembly 7, the unit 10 could be made longer to serve more T-slots or could be made shorter so as to serve fewer.

Figure 10:
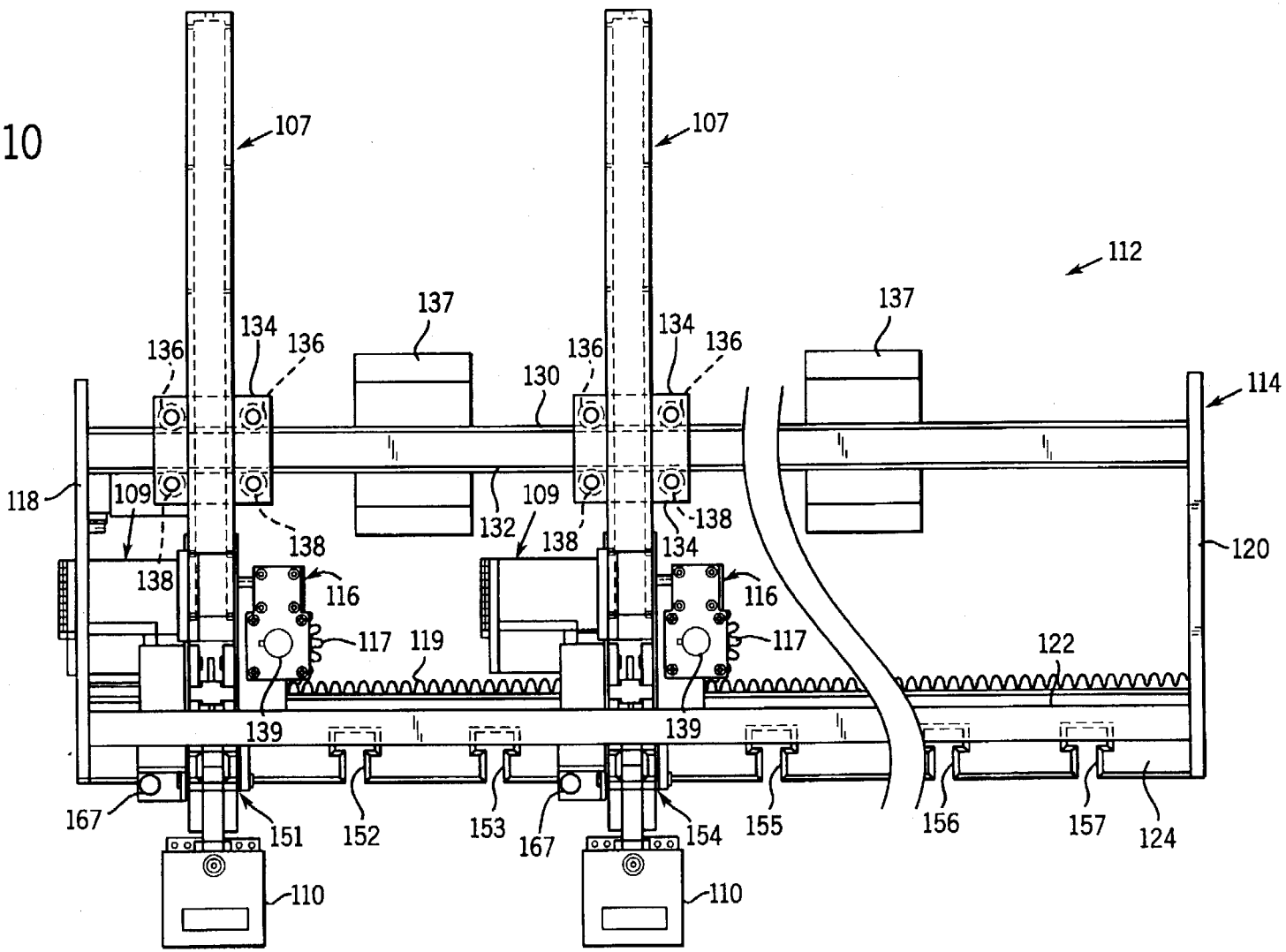
FIG. 10 is a front plan view of an alternate embodiment of a biaxial travelling clamp 112 of the invention.
Figure 11:
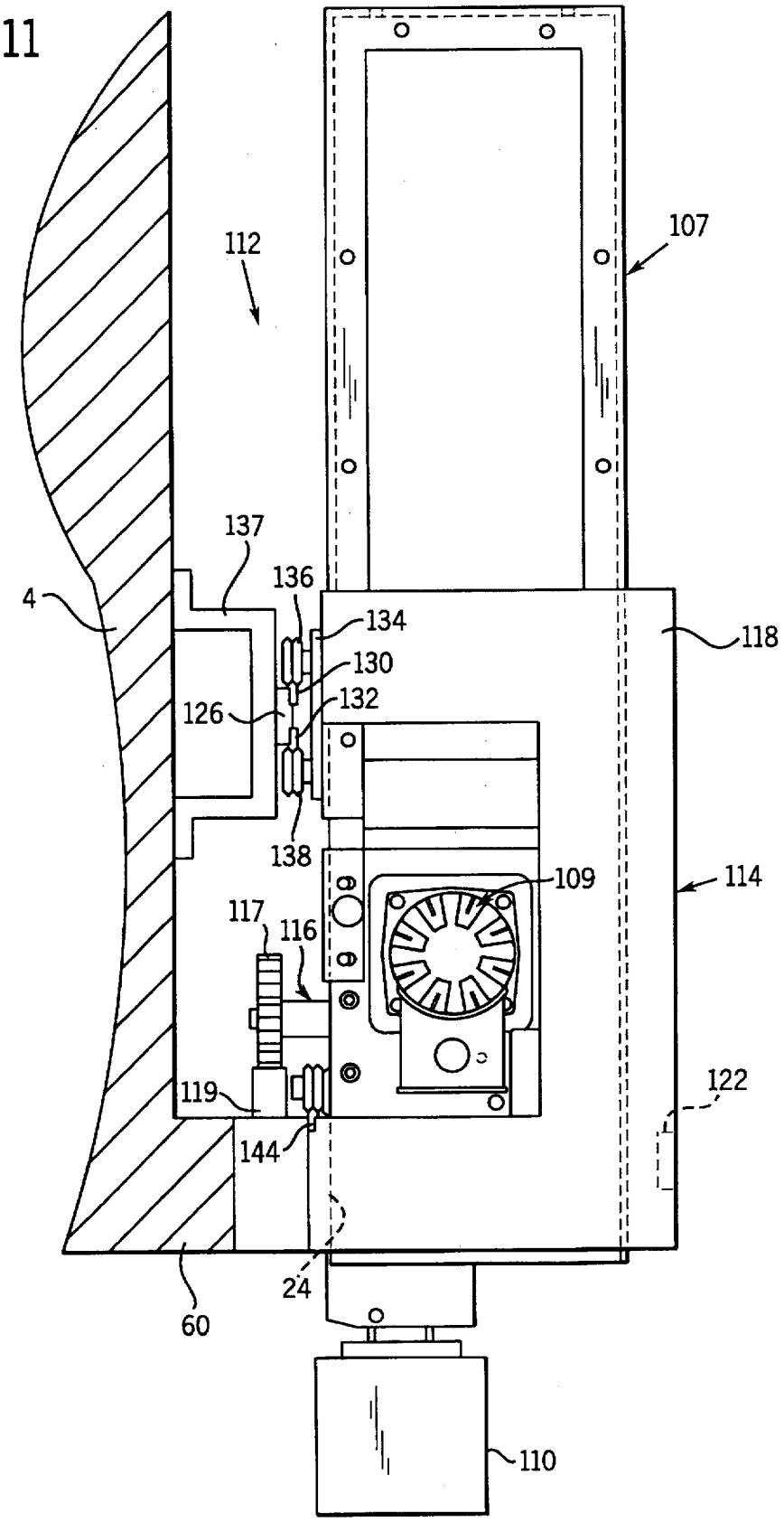
FIG. 11 is a side plan view of the unit 112 of FIG. 10 shown in position relative to a press slide platen.

An alternative embodiment 112 is illustrated in FIGS. 10 and 11. In this embodiment, elements corresponding to the elements of the unit 12 are given the same reference number, plus 100.

The unit 112 is essentially the same as the unit 12 in that a single travelling clamp unit 107 can serve several T-slots.

However, in the embodiment 112, each unit 107 is provided with a separate drive unit 116 which drives a pinion gear 117 along a rack gear 119 which runs for the entire face of the press slide 4 and is secured to the flange 60, for example by welding. Also, in the embodiment 112, the double-V guide rail 126 has been moved to the front of the unit 107 with brackets 137 securing the rail 136 to the front of the press slide 4. The frame 114 including rack gear 119, bar 124 and brackets 137 may be secured to the press slide 4 by welding or other suitable means.

By using an arrangement as illustrated in FIGS. 10 and 11, the T-slots 5 which each unit 107 is capable of serving may overlap. Thus, at least the middle several T-slots may be served by either of the units 107. The end T-slots 151 and 157, however, may only be serviceable by the unit 107 which is on the side that the end T-slot is on.

The motors driving the pinion gears of the units 107 are turned on and off manually or by a suitable controller programmed with the positions of the various T-slots so as to line up each clamp with the desired T-slot. The unit 107 is then actuated to move the clamp head into the T-slot of the slide until the clamping cylinder 110 is in position to clamp the die against the slide, and the clamping cylinder 110 is hydraulically actuated to clamp the die against the slide platen 4. When it is desired to release the die from the slide, hydraulic pressure is relieved from the clamping cylinder 110 and the unit 107 is operated to retract the T-shaped clamp head from the T-slot.

If a controller is used to position the various units 107 at the desired T-slots, the controller must be programmed so that the units 107 do not run into each other. This is a common problem in programming robots and other automated machinery running along a common path. One way of solving it is to use a logic function which sends the furthest left travelling clamp to the furthest left position first and then in sequential order sends each of the other clamps to avoid running over each other. The position of each clamp is remembered by the controller, and the slot positions may be found by counting impulses received from a rotary encoder 139 on the drive unit of each unit 112. The position of each T-slot is programmed into the system.

Figure 12:
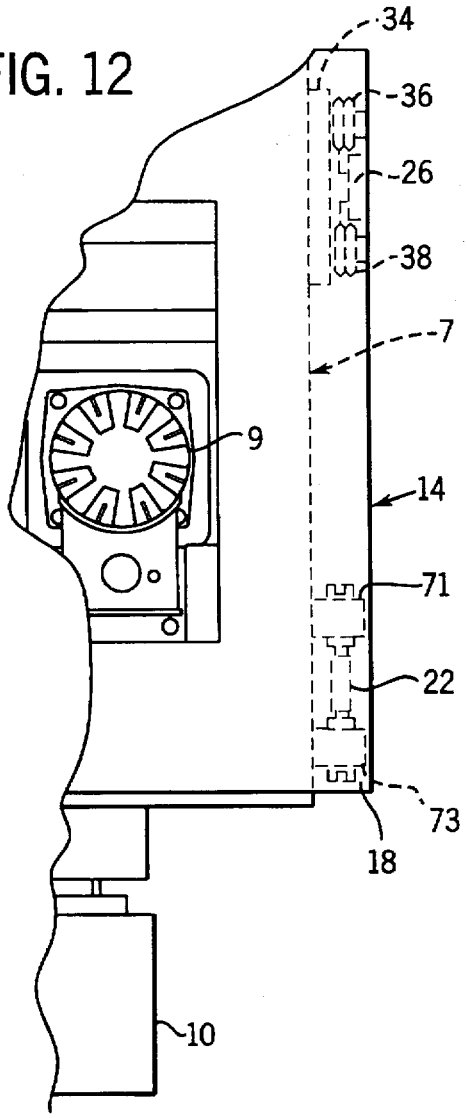
FIG. 12 is a fragmentary side plan view of a modification to the first embodiment 12.
Figure 13:
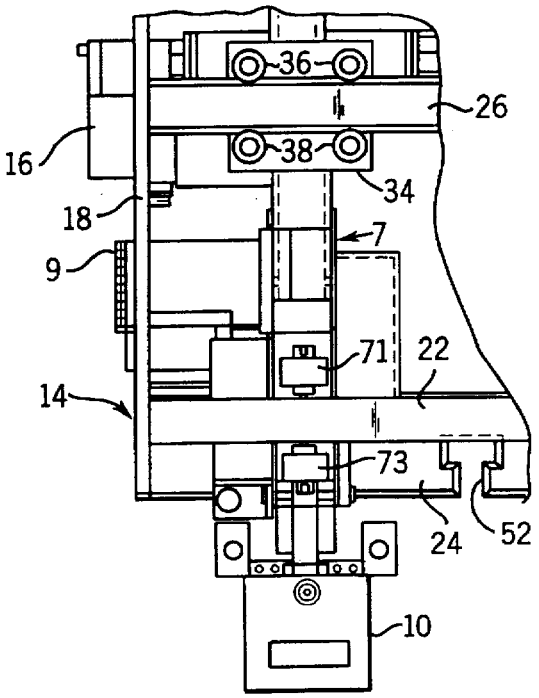
FIG. 13 is a fragmentary side plan view of the modification of FIG. 12.

A modification which may be applied to either of the above-described embodiments is illustrated in FIGS. 12 and 13. It is shown in FIGS. 12 and 13 as applied to the first embodiment 12. In this form, so that the travelling clamp unit 7 remains stationary relative to the frame 14 during operation of the press and to relieve loading from the rollers 36, 38 and 42 and from the corresponding trackways 30, 32 and 44 during operation of the press, an upper 71 and a lower 73 brake cylinder is provided affixed to the travelling clamp unit 7 so as to clamp the front bar 22 between them when the cylinders 71 and 73 are actuated. The brake cylinders 71 and 73 are plumbed into the hydraulic system so as be actuated when the clamping cylinder 10 is actuated. Hoses for plumbing the cylinders 71 and 73 are not shown, but it should be understood that they could very easily be connected to the hose 11. The cylinders 71 and 73 could also be applied to the second embodiment 112, since the second embodiment 112 has a front bar 122 which could be clamped by the cylinders. Of course, it may be possible to reconfigure the cylinders so they clamp on to one of the trackways, in variants of this aspect of the invention.

Preferred embodiments of the invention have been described in considerable detail. Many modifications and variations to the preferred embodiment as described will be apparent to those skilled in the art. Therefore, the invention should not be limited to the embodiments described, but should be defined by the claims which follow.

We claim:

1. In a press of the type having a bolster platen and a slide platen movable toward and away from each other, said platens having confronting surfaces and at least one of said platens being provided with T-slots which open into said confronting surface of said platen, said T-slots being for slidably receiving a T-shaped head of a travelling clamp of the type which extends into or retracts said head from said T-slot, said head being moveable laterally relative to said one of said platens so as to be extendable longitudinally into any one of more than one said T-slot for securing against said surface a tool, the improvement wherein said press further comprises a frame for supporting said travelling clamp apart from said press, said frame comprising: means for mounting said frame along side said T-slots in said platen at an end of said T-slots; means for supporting and guiding said travelling clamp to move back and forth along a lateral path which traverses a plurality of said T-slots so that said head can be aligned with any one of said plurality of T-slots so as to be extendable longitudinally into said one of said plurality of T-slots; and means securing said supporting and guiding means and said mounting means in fixed relationship to one another.

2. The improvement of claim 1, wherein at least two travelling clamps are supported by said frame and movable relative thereto to serve a plurality of T-slots, at least one of said plurality of T-slots being serviceable by at least two of said travelling clamps.

3. The improvement of claim 2, further including power drive means including a gear drive secured to each said travelling clamp which drives said clamp laterally along a gear rack which is common to both said clamps.

4. The improvement of claim 1, further comprising a power drive unit for moving said travelling clamp laterally to align said head with said T-slots.

5. The improvement of claim 4, wherein said power drive unit includes a motor secured to said frame and a guide secured to said travelling clamp.

6. The improvement of claim 1, further comprising a sensor for detecting the position of a destination T-slot.

7. The improvement of claim 6, wherein said sensor is mounted on said clamp.

8. The improvement of claim 6, wherein said sensor is a rotary encoder.

9. The improvement of claim 6, wherein said frame includes a bar having T-slots formed therein which are aligned with T-slots in said platen and said sensor detects the position of said T-slots in said bar.

10. The improvement of claim 1, further comprising one or more brake cylinders affixed to said travelling clamp for clamping onto said frame to fix said travelling clamp laterally relative to said frame.

11. The improvement of claim 10, wherein said brake cylinders are actuated when said T-head clamp is actuated.

* * * * *